US006431788B1

(12) United States Patent
Hedblom et al.

(10) Patent No.: US 6,431,788 B1
(45) Date of Patent: Aug. 13, 2002

(54) WEAR RESISTANT PAVEMENT MARKING

(75) Inventors: Thomas P. Hedblom, Eagan; Eric E. Rice, Woodbury; Curtis W. Meverden, White Bear Township; Gregory E. Gilligan, Hastings; Thomas D. Krech, Cottage Grove, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/191,330

(22) Filed: Nov. 13, 1998

Related U.S. Application Data

(63) Continuation-in-part of application No. 08/974,205, filed on Nov. 19, 1997, now abandoned.

(51) Int. Cl.[7] ..... E01F 9/06; E01F 9/08

(52) U.S. Cl. ..... 404/14; 404/12; 404/17

(58) Field of Search ..... 404/12, 14, 17, 404/19, 20, 21, 6, 9, 15, 16; 52/177, 789.1; D25/163; 152/209.11, 209.12, 902

(56) References Cited

U.S. PATENT DOCUMENTS

| | | | | |
|---|---|---|---|---|
| 894,377 | A | * | 7/1908 | Filler |
| 898,907 | A | * | 9/1908 | Mell |
| D67,523 | S | * | 6/1925 | Irons |
| 1,720,461 | A | * | 7/1929 | Barrett |
| 1,738,829 | A | * | 12/1929 | Jones |
| D88,836 | S | * | 12/1932 | Wheeler |
| D88,976 | S | * | 1/1933 | McFadden |
| D92,073 | S | * | 4/1934 | Greulich |
| D92,074 | S | * | 4/1934 | Greulich |
| D93,992 | S | * | 12/1934 | Moore |
| D181,457 | S | * | 11/1957 | Borger |
| D195,335 | S | * | 6/1963 | Speaker |
| D195,554 | S | * | 7/1963 | Speaker |
| 3,451,537 | A | | 6/1969 | Freeman et al. |
| 4,117,192 | A | | 9/1978 | Jorgensen |

(List continued on next page.)

FOREIGN PATENT DOCUMENTS

| | | | |
|---|---|---|---|
| CA | 1263806 | | 12/1989 |
| DE | 27 16 286 | A | 10/1977 |
| DE | 0 678 625 | A | 10/1995 |
| EP | 101 084 | A2 | 2/1984 |
| EP | 683-268 | A2 | 11/1995 |
| WO | WO 94 04757 | A | 3/1994 |
| WO | WO 96/06982 | A | 3/1996 |
| WO | WO 97/01674 | A | 1/1997 |

OTHER PUBLICATIONS

Patent Abstracts of Japan, vol. 008, No. 124 (M–301), Jun. 9, 1984 & JP 59 029534 A (Nippon Mektron KK) Feb. 16, 1984.

U.S. application No. 08/895,297, Hedblom et al., filed Jul. 16, 1997.

*Primary Examiner*—Gary S. Hartmann
(74) *Attorney, Agent, or Firm*—Robert H. Jordan

(57) ABSTRACT

A pavement marking and methods of making pavement markings are disclosed in which the pavement markings exhibit enhanced wear resistance to, e.g., snowplow blades. The pavement markings include elongated protuberances in which successive elongated protuberances overlap along at least the longitudinal direction and may also overlap in a direction transverse to the longitudinal axis. Other protuberances are interspersed between the elongated protuberances to improve retroreflectivity. The elongated protuberances are provided to support, e.g., a snowplow blade moving over the pavement marking.

15 Claims, 9 Drawing Sheets

U.S. PATENT DOCUMENTS

| | | | | |
|---|---|---|---|---|
| 4,129,673 | A | | 12/1978 | Eigenmann |
| 4,282,281 | A | | 8/1981 | Ethen |
| 4,388,359 | A | | 6/1983 | Ethen |
| 4,490,432 | A | | 12/1984 | Jordan |
| 4,564,556 | A | | 1/1986 | Lange |
| 4,681,401 | A | | 7/1987 | Wyckoff |
| 4,685,824 | A | | 8/1987 | Eigenmann |
| 4,758,469 | A | | 7/1988 | Lange |
| 4,937,127 | A | | 6/1990 | Haenggi et al. |
| 4,969,713 | A | | 11/1990 | Wyckoff |
| 4,988,541 | A | | 1/1991 | Hedblom |
| 4,988,555 | A | | 1/1991 | Hedblom |
| 5,053,253 | A | | 10/1991 | Haenggi et al. |
| 5,087,148 | A | | 2/1992 | Wyckoff |
| 5,094,902 | A | | 3/1992 | Haenggi et al. |
| 5,108,218 | A | | 4/1992 | Wyckoff |
| 5,124,178 | A | | 6/1992 | Haenggi |
| 5,194,113 | A | | 3/1993 | Lasch et al. |
| 5,227,221 | A | | 7/1993 | Hedblom |
| 5,286,682 | A | | 2/1994 | Jacobs et al. |
| 5,536,569 | A | | 7/1996 | Lasch et al. |
| 5,557,461 | A | | 9/1996 | Wyckoff |
| 5,593,246 | A | | 1/1997 | Hedblom et al. |
| 5,643,655 | A | | 7/1997 | Passarino |
| 5,670,227 | A | | 9/1997 | Hedblom et al. |
| 5,676,488 | A | | 10/1997 | Hedblom |
| D394,319 | S | * | 5/1998 | Berger |
| 5,782,577 | A | * | 7/1998 | Stephens |
| D399,011 | S | * | 9/1998 | Berger |

* cited by examiner

WEAR RESISTANT PAVEMENT MARKING

RELATED APPLICATIONS

This is a continuation-in-part of U.S. application Ser. No. 08/974,205 filed Nov. 19, 1997, now abandoned, titled WEAR RESISTANT PAVEMENT MARKING, which is hereby incorporated by reference in its entirety.

FIELD OF THE INVENTION

The present invention pertains to pavement markings. More particularly, the present invention relates to pavement markings to including wear resistant protuberances.

BACKGROUND OF THE INVENTION

Pavement markings are used on roadways to display traffic lanes and other traffic information to motor vehicle drivers. Very often pavement markings are retroreflective so that motor vehicle drivers can vividly see the markings at nighttime. Retroreflective pavement markings have the ability to return a substantial portion of incident light towards the source from which the light originated. Light from motor vehicle headlamps is returned toward the oncoming vehicle to illuminate, e.g., the boundaries of the traffic lanes for the motor vehicle driver.

In view of the important purpose served by pavement markings, investigators have continuously attempted to make various improvements to them. Indeed, the pavement marking art is replete with patented disclosures; see for example U.S. Pat. Nos.: 5,676,488; 5,670,227; 5,593,246; 5,286,682; 5,227,221; 5,194,113; 5,087,148; 4,988,555; 4,988,541; 4,969,713; 4,685,824; 4,490,432; 4,388,359; and 4,117,192.

Known retroreflective pavement markings typically include a rubber base sheet that contains pigments and fillers. Optical elements and/or skid-resistant particles are typically secured to a base sheet by being embedded therein or are secured thereto by a bonding material or binder. Pigments and fillers typically are dispersed throughout the base sheet for a number of reasons, including reducing cost, improving durability, and providing conformability. Pigments have also been placed in the bonding material to enhance visibility of the pavement marking and as part of the retroreflective mechanism.

When the pavement marking is retroreflective, it may include a raised pattern of protuberances on the upper surface of the base sheet to provide a more effective orientation for retroreflection and/or to elevate the optical elements above any water or other liquids on the roadway, thereby enhancing reflectivity of the pavement marking under wet conditions; see, for example, U.S. Pat. Nos. 5,227,221; 5,087,221; 5,087,148; 4,969,713; and 4,388,359.

As the spacing between the raised patterns of protuberances has been increased to improve retroreflectivity by reducing shadowing effects (see, e.g., U.S. Pat. No. 5,670,227), the susceptibility of the pavement marking to snowplow damage has increased. The damage is thought to be caused by the digging action of the snowplow blade as it falls into the valley areas between protuberances and then strikes the sides of the protuberances.

As a result, a need exists for a pavement marking including raised protuberances that is resistant to snowplow damage.

SUMMARY OF THE INVENTION

The present invention provides pavement markings and methods of making pavement markings including elongated protuberances that overlap along the longitudinal axis to improve the wear-resistance of the pavement markings to, e.g., snowplow blades or other objects moved across the pavement marking.

In one aspect, the present invention provides a pavement marking including base sheet having first and second major surfaces, the base sheet having a longitudinal axis and a width generally perpendicular to the longitudinal axis; a plurality of first protuberances projecting from the first major surface of the base sheet; and a plurality of elongated protuberances projecting from the first major surface of the base sheet; wherein the plurality of elongated protuberances overlap along the longitudinal axis of the pavement marking such that a cross-section taken transverse to the longitudinal axis of the pavement marking intersects at least one of the elongated protuberances.

In another aspect, the present invention provides a pavement marking including a base sheet having first and second major surfaces, the base sheet having a longitudinal axis and a width generally perpendicular to the longitudinal axis; a plurality of first protuberances projecting from the first major surface of the base sheet, wherein at least some of the first protuberances are substantially identical in shape and are located in a substantially regular repeating pattern; and a plurality of elongated protuberances projecting from the first major surface of the base sheet, each of the elongated protuberances having a major axis and a minor axis with the major axes of at least some of the elongated protuberances being aligned with the longitudinal axis of the pavement marking, wherein at least some of the elongated protuberances are substantially identical in shape and are located in a substantially regular repeating pattern; wherein the plurality of elongated protuberances overlap along the longitudinal axis of the pavement marking such that a cross-section taken transverse to the longitudinal axis of the pavement marking intersects at least one of the elongated protuberances.

In another aspect, the present invention provides a method of manufacturing a pavement marking by forming a plurality of first protuberances projecting from a first major surface of a polymeric continuous web base sheet having a longitudinal axis and a width generally perpendicular to the longitudinal axis; and forming a plurality of elongated protuberances projecting from the first major surface of the base sheet; wherein the plurality of elongated protuberances overlap along the longitudinal axis of the pavement marking such that a cross-section taken transverse to the longitudinal axis of the pavement marking intersects at least one of the elongated protuberances.

These and other features and advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

The figures are idealized and are not drawn to scale.

DETAILED DESCRIPTION OF ILLUSTRATIVE EMBODIMENTS OF THE INVENTION

Pavement markings according to the present invention include a plurality of first protuberances interspersed between a plurality of elongated protuberances, with both sets of protuberances projecting from the surface of a pavement marking used on a roadway or in a similar application. Successive pairs of the elongated protuberances preferably overlap at least, along the longitudinal axis of the pavement marking to improve the wear resistance of the pavement markings as discussed in more detail below. Each set of protuberances need not necessarily be regularly shaped, sized, or spaced-apart. However, the present invention is perhaps most easily understood and explained with reference to the embodiments described herein in which each of the different protuberances are regularly shaped and spaced.

One set of the protuberances is preferably designed to minimize shadowing of adjacent protuberances (in the line of sight of a driver) by spacing the protuberances further apart as well as offsetting them laterally (with respect to the line of sight of the driver) than is typical in many conventional pavement markings. Examples of such configurations are described in commonly-assigned U.S. Patent Application titled RETROREFLECTIVE BLACK PAVEMENT MARKING ARTICLES, filed on Jul. 16, 1997 (U.S. Ser. No. 08/895,297), as well as in U.S. Pat. No. 5,670,227.

Figure 1:
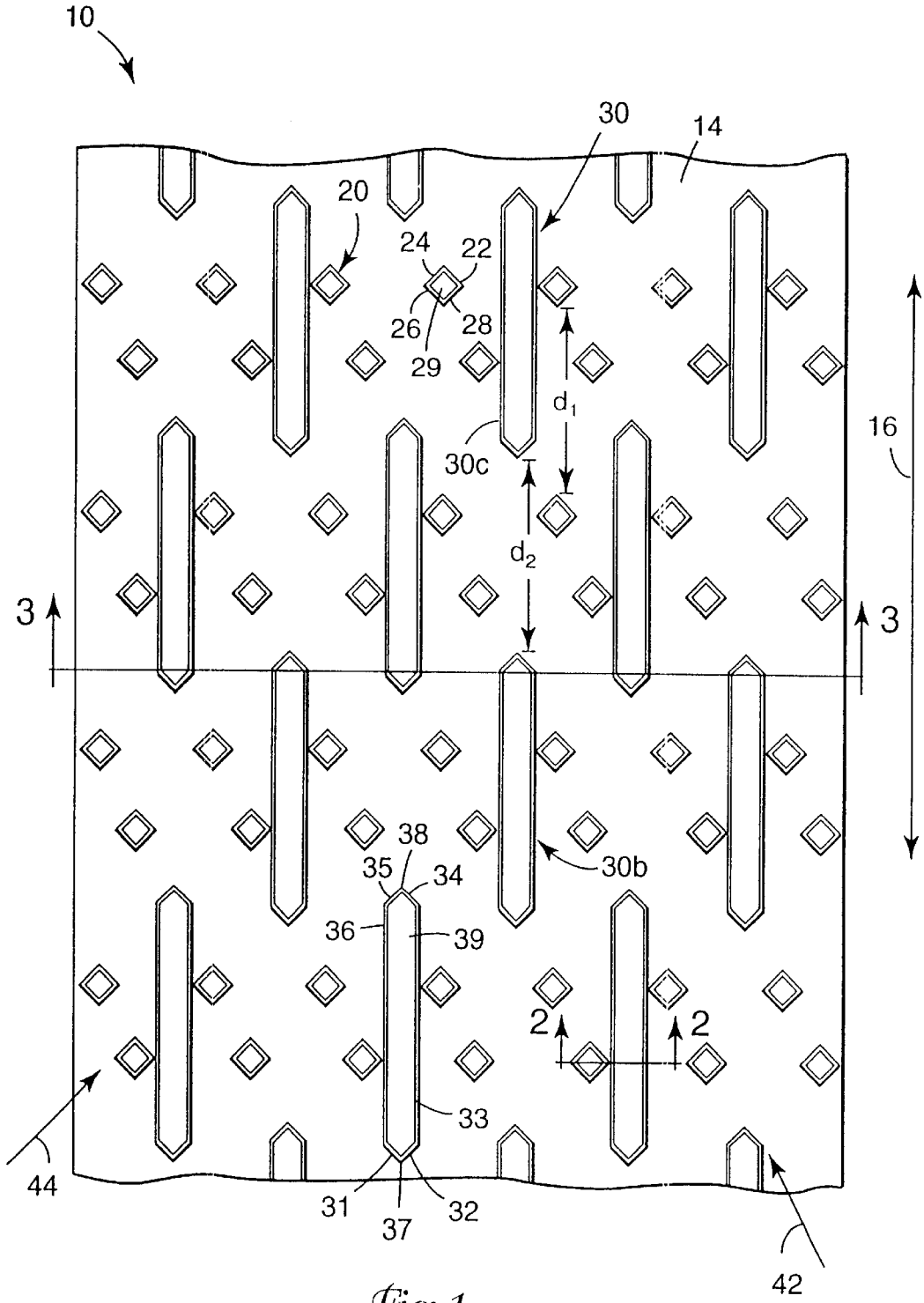
FIG. 1 illustrates a top view of an illustrative pavement marking 10 in accordance with the present invention.
Figure 2:
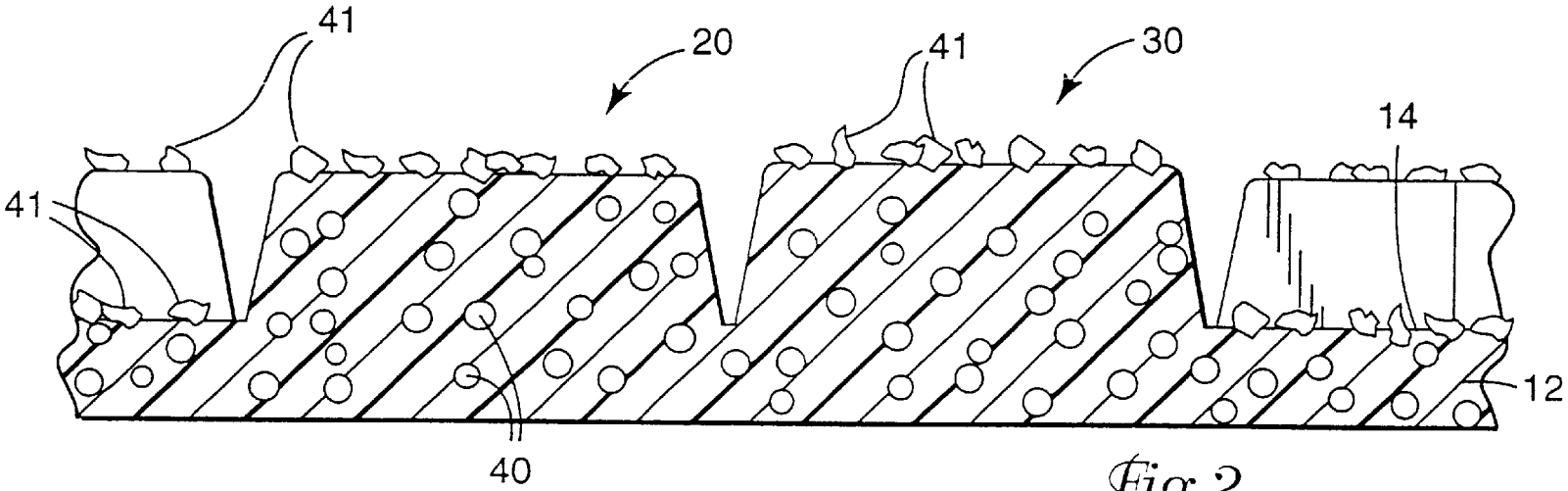
FIG. 2 is an enlarged partial cross-sectional view of pavement marking 10 of FIG. 1 taken along line 2—2.

One retroreflective pavement marking 10 according to the invention is depicted in FIGS. 1 and 2 and includes a base sheet 12 that has a plurality of first protuberances 20 located thereon. Interspersed between the first protuberances 20 on the base sheet 12 are second protuberances 30. The protuberances 20/30 are preferably, but not necessarily, formed as an integral part of the base sheet 12, i.e., as one single unit and not two separate parts subsequently joined together. Both sets of protuberances 20 and 30 are preferably spaced apart from each other by valley areas 14. The raised nature of the protuberances 20 and 30 improves the visibility of the pavement marking 10 in wet conditions. FIG. 1 also depicts a longitudinal axis 16 that is preferably the general direction from which light from, e.g., a vehicle headlight, would be expected when the pavement marking 10 is applied to a roadway or other surface.

As illustrated in the embodiment depicted in FIG. 1, the first protuberances 20 are preferably arranged on the base sheet 12 in a predetermined pattern. The first protuberances 20 shown in FIG. 1 generally have a square outline defined by four side surfaces 22, 24, 26, and 28, that meet at a top surface 29. The length of each side surface 22–28, typically is about 4 to 10 millimeters, more typically about 6 millimeters. Each of the protuberances 20 is preferably oriented such that the sides 22–28 form an angle of about 45 degrees with the longitudinal axis 16 of the pavement marking 10.

Although the first protuberances 20 depicted in FIG. 1 have a square outline, it will be understood that the first protuberances 20 could take any desired shape, including, but not limited to: circular, oval, polygonal, etc. As illustrated, however, it may be preferred that the length of the protuberances 20 (as measured along the longitudinal axis 16) is generally about equal to the width of the protuberances 20 (as measured generally perpendicular to the longitudinal axis 16).

The second protuberances 30 are also preferably arranged on the base sheet 12 in a predetermined pattern. The preferred second protuberances 30 are provided as elongated rails that are preferably generally aligned along the longitudinal axis 16 of the pavement marking 10 as shown. The length of the second protuberances 30 (as measured along the longitudinal axis 16) is preferably greater than the width of the protuberances 30 (as measured generally perpendicular to the axis 16). More preferably, the length of the protuberances 30 is at least about two times the width of the protuberances 30; and even more preferably, the length of the protuberances 30 is at least about four times the width of the protuberances 30, and still more preferably, the length of the protuberances 30 is at least about six times their width. In one preferred embodiment, the overall length of the each of the protuberances 30 is about 67 millimeters and the width is about 8 millimeters.

The preferred protuberances 30 depicted in FIG. 1 are formed by six side surfaces 31–36 that meet at a top surface 39. The length of each side surface 31, 32, 33, 34 at the leading end 37 and trailing end 38 of each protuberance 30 is preferably generally equal to the length of the side surfaces 22–28 of the first protuberances 20, i.e., typically is about 4 to 10 millimeters, more typically about 6 millimeters. Although one preferred shape for the second protuberances 30 is depicted in FIG. 1, it will be understood that the second protuberances 30 could take any desired regular or irregular elongated shape, including, but not limited to: oval, elliptical, polygonal, etc.

Also included in the preferred pavement markings according to the present invention are optical elements to improve the visibility of the pavement marking 10. The optical elements 40 are best seen in FIG. 2, an enlarged partial cross-sectional view of pavement marking 10 taken along line 2—2 in FIG. 1. The optical elements 40 are preferably provided on at least the some, preferably all, of the side surfaces 22–28 of the first protuberances 20. In addition, it is also preferred that the optical elements 40 be provided on the at least some, preferably all, of the side surfaces 31–36 of the elongated protuberances 30. In some embodiments, it may also be desirable to provide optical elements on the top surfaces 29 of the first protuberances 20 and/or the top surfaces 39 of the elongated protuberances 30, as well as in the valley areas 14.

The optical elements 40 will typically comprise retroreflective elements such as beaded retroreflectors, although any structure or material that provides reflection, preferably retroreflection, of incident light is preferred. The types and sizes of, e.g., beaded retroreflective elements will vary depending a variety of factors that will be well known to those skilled in the art.

It may also be desirable to provide skid-resistant particles 41 on the protuberances 20 and/or 30 as well as the valley areas 14 to improve friction between the pavement marking 10 and, e.g., a vehicle tire. The types and sizes of skid-resistant particles 41 that would be useful in connection with the present invention will be well known to those skilled in the art.

The first protuberances 20 are preferably sized and spaced to provide visible reflectance (preferably retroreflection) of light incident on the pavement marking 10. As a result, the protuberances 20 have a relatively short length when compared to the length of the second protuberances 30 (where both lengths are measured along the longitudinal axis 16). The short length of the first protuberances 20 increases the total surface area of the protuberances 20 visible to, e.g., drivers of vehicles viewing the pavement marking 10 from relatively great distances.

The second protuberances 30 are provided to accomplish a number of functions. One of those functions is to reduce the digging action of, e.g., snowplow blades, that are pushed or dragged over the pavement marking when in position on a road or other surface. The elongated second protuberances accomplish that function in part by their length and in part by their arrangement on the pavement marking 10.

In the pattern depicted in FIG. 1, successive protuberances 30 (see specifically 30*a* and 30*b*) are preferably laterally offset across the width of the pavement marking 10 and overlap along the longitudinal axis 16 of the pavement marking 10. In other words the trailing end of the first elongated protuberance 30*a* preferably extends past the leading end of the successive elongated protuberance 30*b*. The overlap along the longitudinal axis 16 between successive elongated protuberances 30*a* and 30*b* is preferably about 5 millimeters or more, more preferably about 10 millimeters or more, and even more preferably about 20 millimeters or more.

The lateral offset of successive protuberances 30*a* and 30*b* across the width of the pavement marking 10 is preferably about 10 millimeters or more, more preferably about 20 millimeters or more (measured between the centers of the successive protuberances 30*a* and 30*b*). The upper limit for the lateral offset is the width of the pavement marking formed using the pattern. In other words, the lateral offset between successive protuberances can be only as large as the width of the pavement marking. If the lateral offset is larger than the width of the pavement marking, then the requirement that the pavement marking contain successive protuberances that overlap longitudinally will not be met.

In one preferred embodiment, the overlap along the longitudinal axis 16 between successive elongated protuberances 30*a* and 30*b* is about 8 millimeters and the lateral offset across the width of the pavement marking 10 is about 26 millimeters.

By providing the longitudinal overlap between the successive elongated protuberances 30, snowplow blades and similar sharp edged objects are prevented from falling into the valley areas 14 on the pavement marking 10. As a result, the first protuberances 20 are largely protected from the blades. Likewise, the side surfaces of the elongated protuberances 30 are also somewhat protected as the blades slide over the top surfaces 39 of the protuberances 30.

Figure 3:
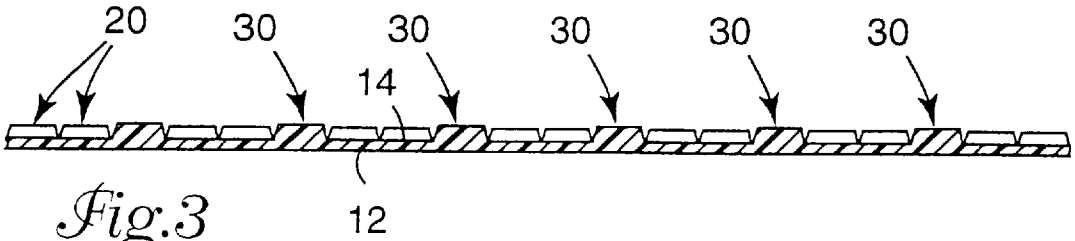
FIG. 3 illustrates a cross-section of pavement marking 10 of FIG. 1 taken along line 3—3.

The result of longitudinally overlapping the successive elongated protuberances 30 is that a cross-section taken across the width of the pavement marking 10 (transverse to the longitudinal axis 16) will intersect a plurality of the elongated protuberances 30 at all points along the length of the pavement marking 10. That is illustrated in FIG. 2 which is a cross-section of the pavement marking 10 of FIG. 1 taken along line 2—2. Although the cross-section depicted in FIG. 3 intersects a plurality of elongated protuberances 30, preferred pavement markings according to the present invention contain a sufficient number of elongated protuberances that are spaced apart in a manner such that any cross-section taken across the width of a given pavement marking intersects at least one elongated protuberance upon which a snowplow blade rides.

To further enhance the wear resistance of the pavement marking 10, it is also preferable to provide the elongated protuberances 30 with a height that is greater than the height of the first protuberances 20 as best seen in FIG. 2. Preferably, the height of the elongated protuberances 30 is about 0.1 millimeters greater than the height of the first protuberances 20, more preferably about 0.25 millimeters or more. By providing the elongated protuberances 30 that are taller than the interspersed first protuberances 20, contact between, e.g., a snowplow blade, and the lower protuberances 20 can be further reduced. In addition, unevenness in the surface to which the pavement marking 10 is applied can be compensated for by the taller elongated protuberances 30.

The combination of first protuberances 20 interspersed among the elongated protuberances 30 provides another advantage in that the reflective performance of the pavement marking 10 is enhanced while, at the same time, the wear resistance of the pavement marking 10 is also improved. The elongated protuberances 30 can enhance visibility of the pavement marking 10, particularly at angles off of the longitudinal axis. In other words, light from headlights of vehicles approaching along a path aligned with arrow 42 or arrow 44 in the patterns formed by the first protuberances 20 will reflect from only the aligned sets of protuberances 20 with gaps formed between the aligned protuberances 20. By providing the elongated protuberances 30, however, light from those angles will also reflect from the sides of the elongated protuberances 30 which effectively cover the gaps that would otherwise appear at those approach angles.

The patterns and spacing between the protuberances 20 and 30 can vary as desired provided that the overlap and lateral offset between successive elongated protuberances is maintained. FIG. 1 does, however, depict one example of a pattern of first protuberances 20 and a superimposed pattern of second protuberances 30. In the depicted patterns, the first protuberances 20 are provided in columns parallel to the longitudinal axis 16. The first protuberances 20 are spaced apart in the columns by a distance ($d_1$) that is sufficient to reduce shadowing effects for successive protuberances 20 in the longitudinal direction. The first protuberances 20 in the adjacent column are preferably spaced apart by the same distance ($d_1$) as are protuberances 20 in the first column, but are offset longitudinally from the adjacent column by a distance of $d_1/3$, i.e., one-third of $d_1$. In preferred patterns, there is no lateral space between adjacent columns of protuberances 20 which have the same width as the protuberances 20 in the columns.

The spacing $d_1$ between successive protuberances 20 in each column is, at least in part, provided to enhance retroreflectivity by minimizing shadowing or blocking. It will be understood that spacing between the protuberances 20 may also be based on the height of the protuberances 20 as the height will also affect shadowing or blocking.

The distance $d_1$ is preferably at least about two times the longitudinal length of the protuberances 20, more preferably at least about four times the longitudinal length of the protuberances 20; and even more preferably at least about six times the longitudinal length of the protuberances 20. In one preferred embodiment, the spacing $d_1$ between successive first protuberances in each column is about 51 millimeters for protuberances 20 having a length of about 8 millimeters (as measured along the longitudinal axis 16) and a height of about 1.7 millimeters above the valley areas 16 in pavement marking 10. An example of a similar pattern can be found in commonly-assigned U.S. Patent Application titled RETROREFLECTIVE BLACK PAVEMENT MARKING ARTICLES, filed on Jul. 16, 1997 (U.S. Ser. No. 08/895,297) as well as in U.S. Pat. No. 5,670,227.

In the pattern depicted in FIG. 1, every third column of protuberances 20 is replaced by a column of elongated protuberances 30. Within each column of protuberances 30, the trailing end of the lower protuberance 30*b* is located a distance $d_2$ from the leading end of the successive protuberance 30*c*. The distance $d_2$ is preferably about equal to or less than the longitudinal length of the protuberances 30. It is preferred, but not required, that the distance $d_1$ between successive first protuberances 20 in a column be about equal to the distance $d_2$ between successive second protuberances 30 in a column. The laterally adjacent columns of protuberances 30 (with a plurality of protuberances 20 located therebetween) are preferably offset longitudinally by a distance that is less than the length of the protuberances 30 to provide the desired overlap between protuberances 30 as described above. The adjacent columns of protuberances 30 are preferably offset laterally by a distance equal to the width of the intervening columns of first protuberances 20.

Figure 4:
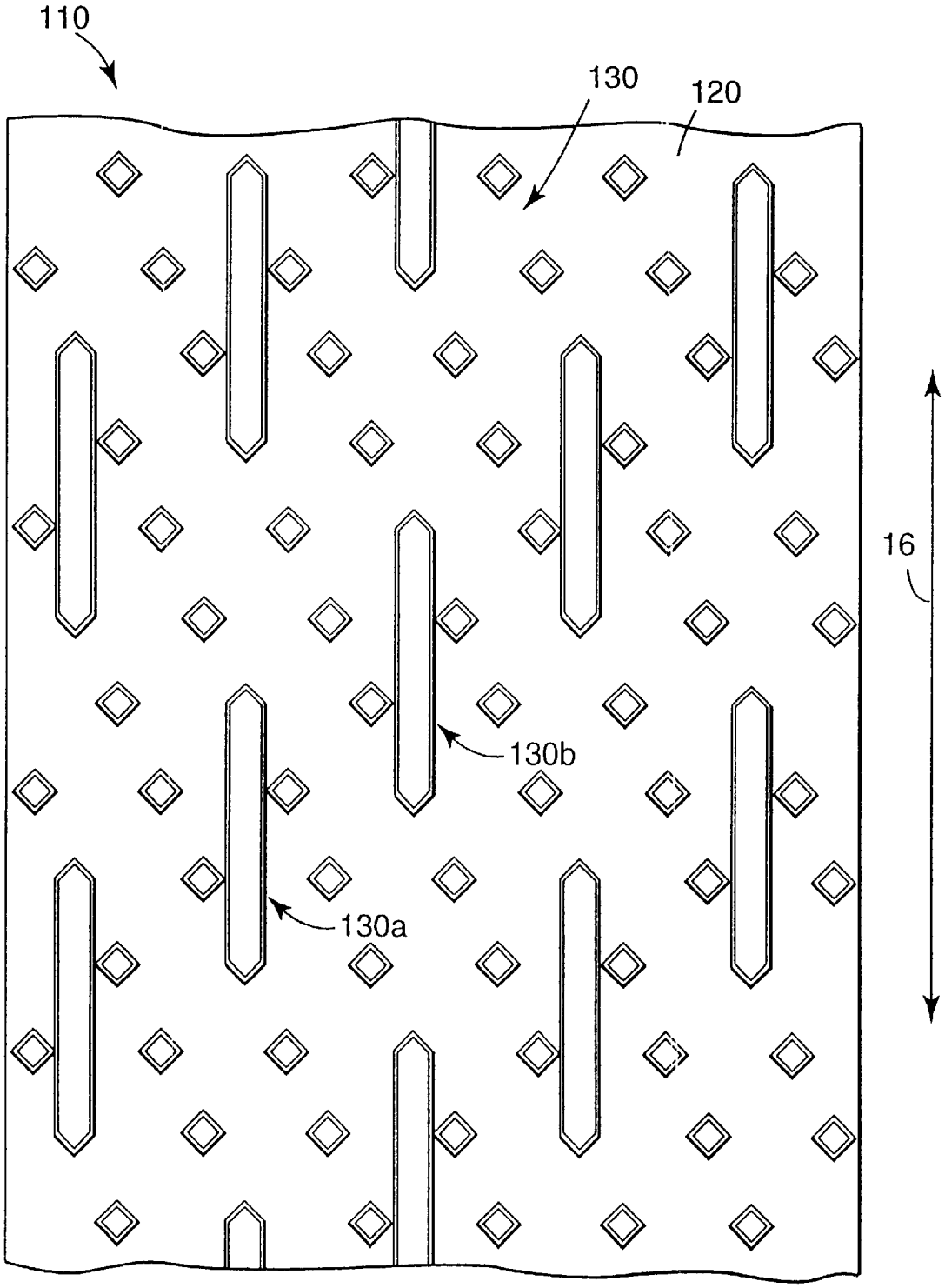
FIG. 4 illustrates a top view of another illustrative pavement marking 110 in accordance with the present invention.

FIG. 4 depicts an alternative pavement marking 110 according to the present invention in which the first protuberances 120 and second elongated protuberances 130 are arranged differently than in pavement marking 10 depicted in FIG. 1. The primary difference between the pavement markings 10 and 110 is that in pavement marking 110 three adjacent columns of protuberances 120 are interposed between adjacent columns of elongated protuberances 130. In contrast, pavement marking 10 includes only two adjacent columns of protuberances 20 between adjacent columns of elongated protuberances 30.

In all other aspects, the above discussions relating to the construction of pavement marking 10 also apply to pavement marking 110. This is especially true with respect to the need for overlap between successive elongated protuberances 130*a* and 130*b* to reduce the digging action that would otherwise be encountered from, e.g., snowplow blades.

The two pavement markings 10 and 110 illustrate the balance between wear resistance and reflectivity when designing patterns of first and second protuberances for pavement markings according to the present invention. In general, the reflective performance of pavement marking 110 for light approaching along the longitudinal axis 116 will be greater than the reflective performance of pavement marking 10 for light approaching along the longitudinal axis 16. The difference in reflective performance is due to the increased number of first protuberances 120 in the pavement marking 110.

In contrast to reflective performance, however, the wear resistance of pavement marking 10 should generally be improved over the wear resistance of pavement marking 110 due to the increased number of elongated protuberances 30 provided in pavement marking 10 (for pavement markings of a given width). In addition, the pavement markings that could be provided using a pattern such as that depicted in FIG. 1 could be narrower while maintaining a sufficient number of elongated protuberances 30 to improve wear resistance, i.e., at least one elongated protuberance 30 in any cross-section taken along the width of the pavement marking.

Figure 5:
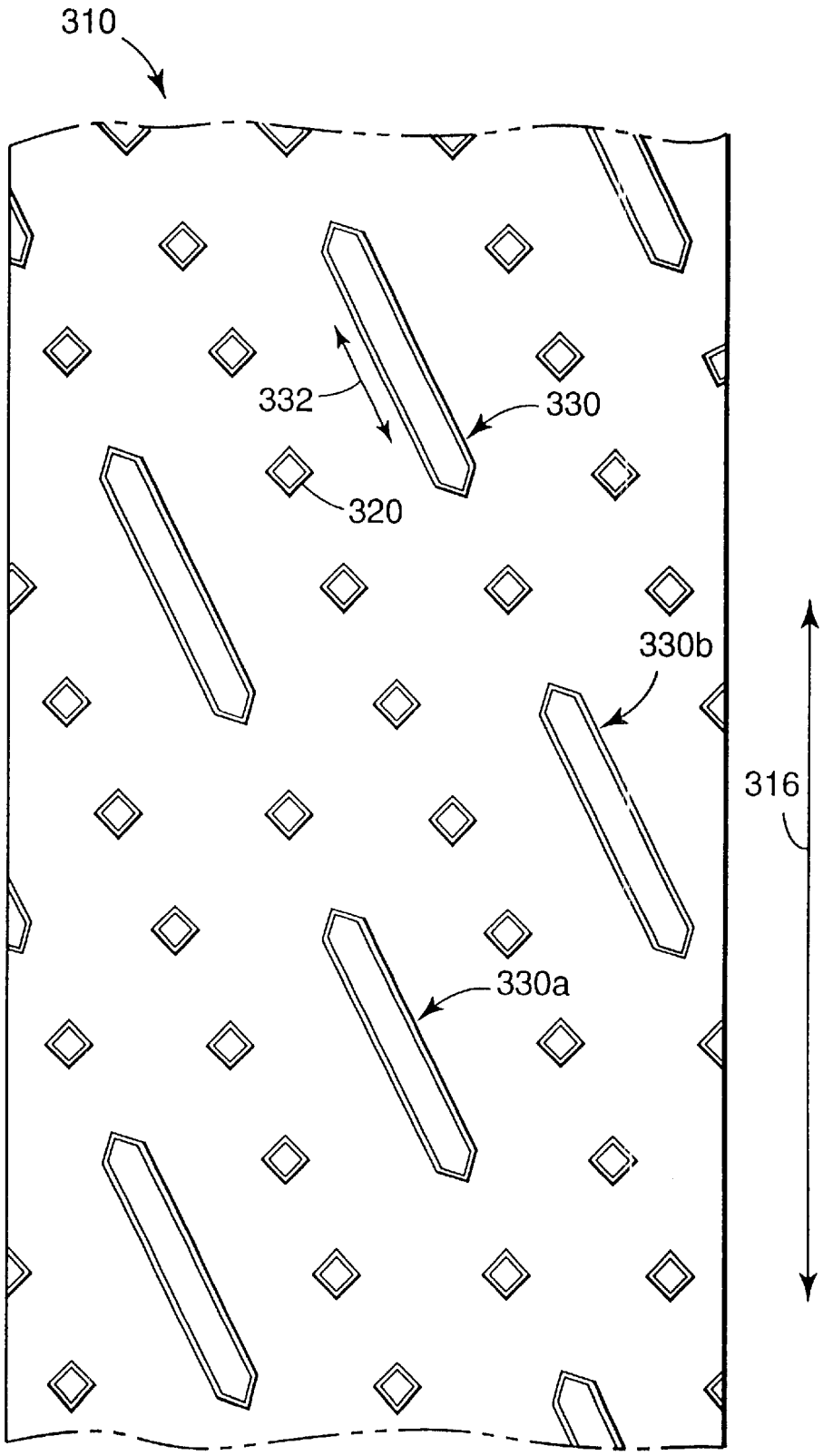
FIG. 5 is a top view of an alternate pavement marking according to the present invention.

FIG. 5 illustrates another variation in the patterns of protuberances provided on pavement markings according to the present invention. The pavement marking 310 includes a plurality of first protuberances 320 and a plurality of second protuberances 330. The first protuberances 320 are interspersed among the second protuberances 330. The second protuberances 330 are elongated, i.e., they have a length along an axis that is greater than their width transverse to that axis. In addition, the second protuberances 330 are preferably generally aligned with an axis 332 that is not parallel to the longitudinal axis 316 of the pavement marking 310.

The second protuberances 330 are, like those described above, preferably arranged such that successive second protuberances 330 overlap along the longitudinal axis 316 as illustrated by second protuberances 330*a* and 330*b*. As a result, the pavement marking 310 will also exhibit improved resistance to wear as described above.

Figure 6:
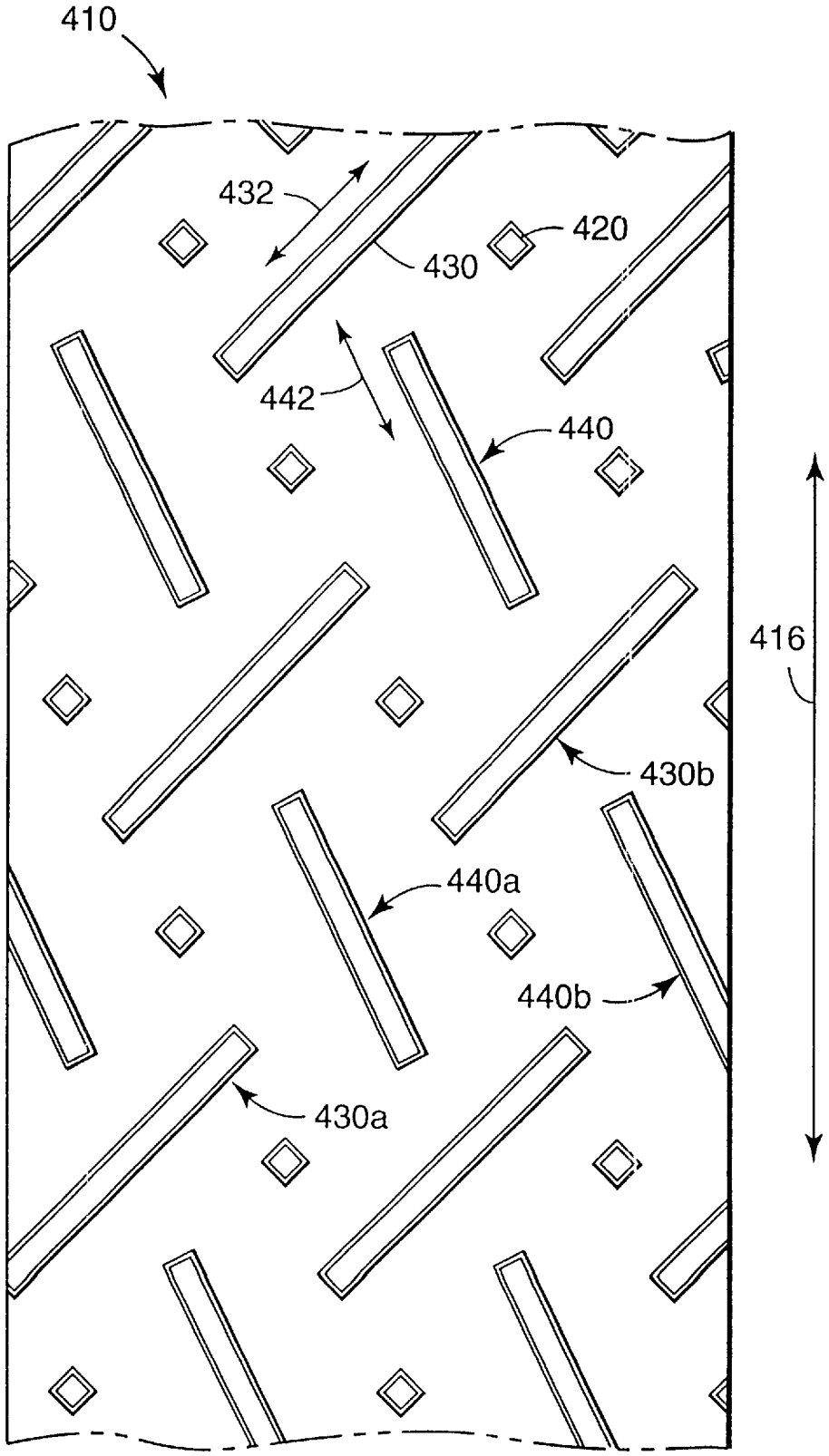
FIG. 6 is a top view of an alternate pavement marking according to the present invention.

FIG. 6 illustrates yet another variation in the arrangement of protuberances on a pavement marking according to the present invention. The pavement marking 410 includes three sets of protuberances 420, 430 and 440. The first protuberances 420 are interspersed among the generally elongated second and third protuberances 430 and 440. Second protuberances 430 are canted with respect to the longitudinal axis 416, i.e., the second protuberances 430 are generally aligned with an axis 432 that is not parallel to the longitudinal axis 416 of the pavement marking 410. Third protuberances 440 are also canted with respect to the longitudinal axis 416, i.e., they are preferably generally aligned with an axis 442 that is also not parallel to the longitudinal axis 416 of the pavement marking 410. Furthermore, the axis 442 preferably intersects axis 432 along which the second protuberances 430 are generally aligned. Both sets of protuberances 430 and 440 are generally elongated, i.e., they have a length along an axis that is greater than their width transverse to that axis.

The second and third protuberances 430 and 440 are preferably arranged such that successive second and third protuberances 430 and 440 overlap along the longitudinal axis 416 of the pavement marking 410 as illustrated by second protuberance 430*a* and 440*a*. As a result, the pavement marking 410 will also exhibit improved resistance to wear in the direction of the longitudinal axis 416 as described above.

An additional feature of the pattern of protuberances in pavement marking 410 is that successive second and third protuberances 430 and 440 also overlap across the width of the pavement marking 410, i.e., transverse to the longitudinal axis 416 of the pavement marking 410. This overlap is illustrated by second protuberance 430*b* and third protuberance 440*b* and, as a result, any cross-section taken along the longitudinal axis 416 of the pavement marking 410 will intersect a plurality of the elongated protuberances 430/440.

The advantage of this pattern is that the pavement marking 410 will also exhibit improved wear resistance to, e.g., snowplow blades, moving across the pavement marking 410 in a wide variety of approach angles. As a result, pavement marking 410 may be particularly useful in applications in which the approach angle of, e.g., snowplow blades, may not be substantially along the longitudinal axis 416 of the pavement marking 410. Examples of such application include, but are not limited to: crosswalks, parking stalls in parking lots, directional arrows, etc.

Figure 7:
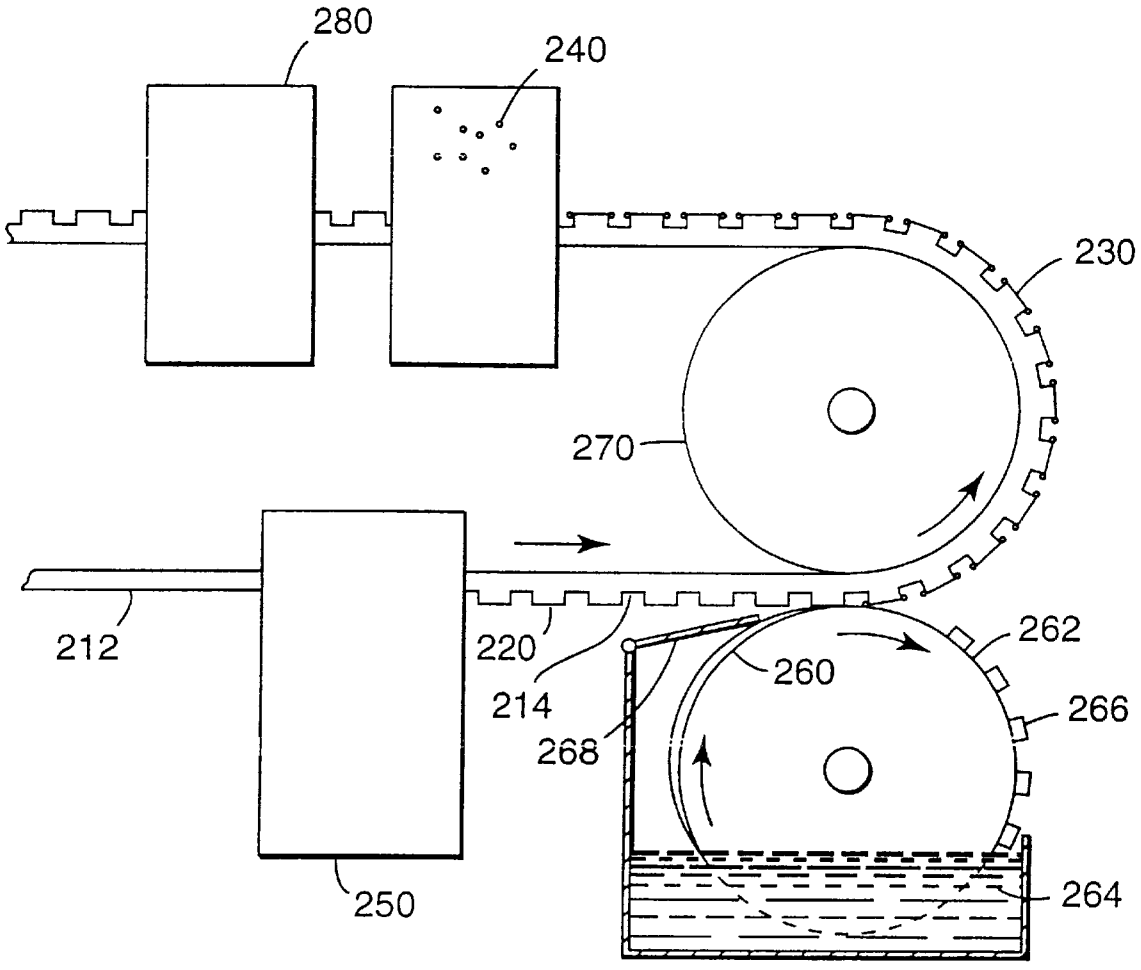
FIG. 7 is a schematic diagram of one method of manufacturing a pavement marking according to the present invention.

FIG. 7 is a schematic diagram of one method of manufacturing a pavement marking according to the present invention. The first step in that process involves forming first and second protuberances 220/230 on one surface of a base sheet 212 with the protuberances 220/230 being separated by valley areas 214. The step of forming the protuberances may involve forming the different types of protuberances 220/230 used in pavement markers according to the present invention simultaneously. For example, first protuberances 220 and elongated protuberances 230 could be formed at the same time or sequentially. Regardless of the order in which the protuberances 220/230 are formed, they are preferably formed from base sheet 212 by an embosser 250 to yield protuberances 220/230 that are integral with the base sheet 212. Although embossing is one preferred method, it will be understood that other methods could be employed to provide a base sheet and protuberances, e.g., molding, lamination, etc.

The process conditions required for embossing the base sheet 212 with protuberances according to the present invention are dependent on the physical properties of the base sheet 212 at the process temperatures of the embosser and on the nip forces generated within the embosser 250. Although we do not wish to be held to any theory, it is generally believed that as the viscosity of the base sheet 212 increases, and as the embossing forces decrease, a thicker input base sheet 212 should be used. Under those conditions, it may be preferred to increase the amount of stretch on the base sheet 212 in the machine direction immediately prior to embossing to achieve a desired valley thickness.

The preferred pavement markings according to the present invention also include optical elements and/or skid-resistant particles on the protuberances 220/230 to enhance reflectivity and/or skid resistance. Those optical elements and/or skid-resistant particles are typically held in place by coatings that are applied to the protuberances 220/230.

Methods of coating protuberances 220/230 and the materials that can be used for that purpose are described in, e.g., U.S. Pat. Nos. 4,988,555 and 5,676,488 (both to Hedblom). One method of coating the protuberances 220/230 is however, depicted in FIG. 5 and involves orienting the protuberances 220/230 downward and contacting a film 260 of coating material. The coating material is provided by a print roller 262 that is partially immersed in reservoir of liquid coating material 264. The thickness of the film 260 of coating material 264 can be controlled, e.g., by a doctor blade 268 or any other suitable device or method.

A backing roller 270 forces the base sheet 212 against the film 260 of coating material 264 formed on the print roller 262. As the protuberances contact the film 260, a discontinuous layer of coating material 264 is preferably applied to or printed on the protuberances 220/230. The portions 266 of the film 260 that do not adhere to the protuberances 220/230 or the valley areas 214 are returned to the reservoir of coating material 264 on the print roller 262.

The above described coating process raises yet another advantage of pavement markings according to the present invention in that the overlap between successive elongated protuberances 230 provides for more even and controlled application of the coating material 264 on all of the protuberances 220/230. That even and controlled application is provided because, typically, a plurality of the elongated protuberances 230 will be in contact with the print roller 262 at all times, thereby maintaining a consistent distance between the print roller and protuberances 220/230. The consistent spacing provided by the overlapping elongated protuberances 230 allows for more controlled application of the coating material 264 onto the sides of the protuberances 220/230 while reducing or eliminating the amount of coating material 264 deposited on the top surfaces of the protuberances 220/230 (if that is desired). The consistent spacing also assists in reducing, or preferably eliminating, application of the coating material 264 to the valley areas 214.

The factors that affect controlled application of the coating material 264 to the pavement marking 210, such as viscosity of coating material 264, nip pressure between the backing roller 270 and print roller 262, hardness of the pavement marking 210, etc. are discussed in, e.g., U.S. Pat. No. 4,988,555 (Hedblom) and will not be further discussed here. Furthermore, although the preferred method illustrates discontinuous coating, it is also within the scope of the present invention to provide a pavement marking that is completely coated over at least one entire surface, i.e., protuberances 220/230 and valley areas 214. Examples can be found in U.S. Pat. Nos. 5,593,246 and 5,676,488.

After the coating material 264 is in place on the protuberances 220/230, the pavement marking 210 is then inverted such that the protuberances 220/230 are now facing upward with the coating material 264 located on the sides of the protuberances 220/230. The next step then involves contacting the pavement marking 210 with optical elements and/or skid-resistant particles 240 such that they adhere to the pavement marking 210 in the areas in which the coating material 264 is present. The exact methods used to deliver the optical elements and/or skid-resistant particles 240 may include flood coating, sprinkling, cascading, etc. and the exact method will depend on many factors including particle size, viscosity of the coating material 264, web speed and others. A vacuum system may be used to remove excess optical elements and/or skid-resistant particles 240 and a beater bar or other vibration device may be helpful to uniformly distribute optical elements and/or skid-resistant particles 240, especially if it is desired to place optical elements and/or skid-resistant particles 240 on the top surfaces of the protuberances 220/230.

The coating material 264 with attached optical elements and/or skid-resistant particles 240 is then preferably cured or otherwise processed such that the optical elements and/or skid-resistant particles 240 are firmly affixed to the desired areas on the pavement marking 210. For example, where the coating material is a thermosetting plastic, the pavement marking 210 may be directed into an oven 280 to cure the thermosetting coating material.

Other methods of forming protuberances on a base sheet and attaching optical elements and/or skid-resistant particles to pavement markings according to the present invention are described in, e.g., U.S. Pat. Nos. 3,451,537; 4,117,192; 4,988,555; 5,194,113; 5,593,246; and 5,676,488.

Figure 8:
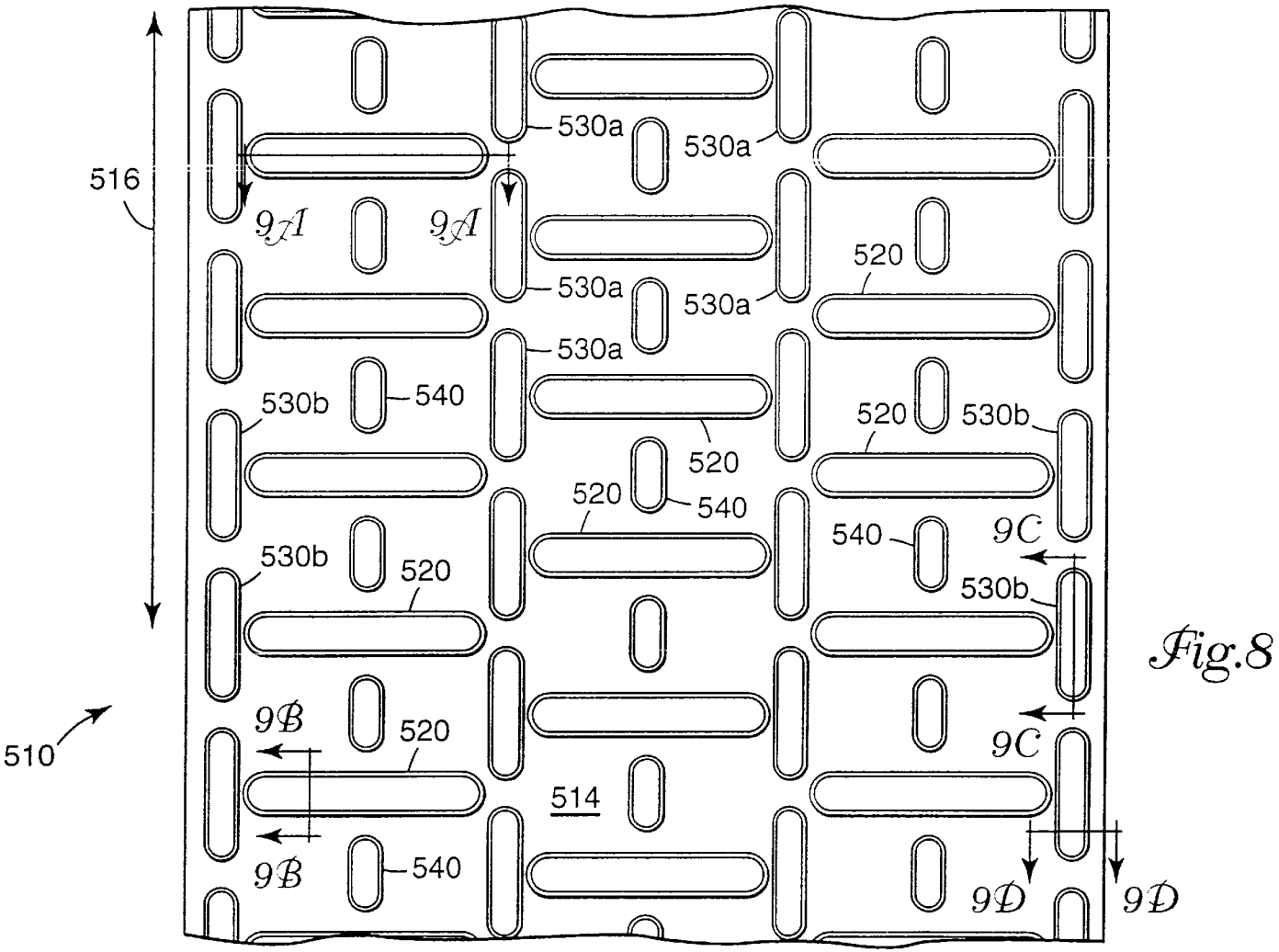
FIG. 8 is a top view of an alternate pavement marking according to the present invention.
Figure 9A:
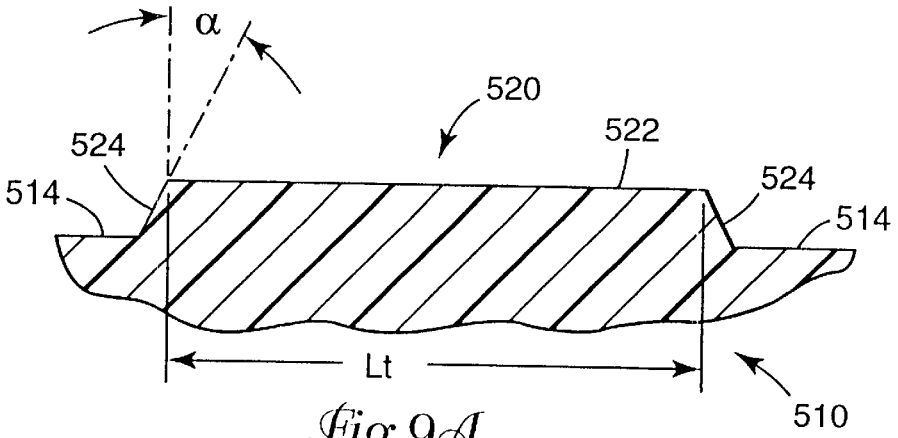
FIG. 9A is an enlarged partial cross-sectional view of the pavement marking of FIG. 8 taken along line 9A—9A.
Figure 9B:
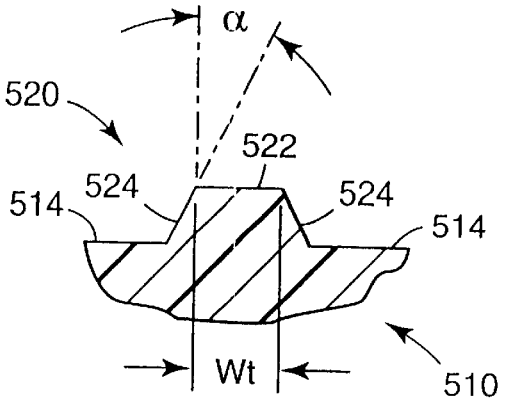
FIG. 9B is an enlarged partial cross-sectional view of the pavement marking of FIG. 8 taken along line 9B—9B.
Figure 9C:
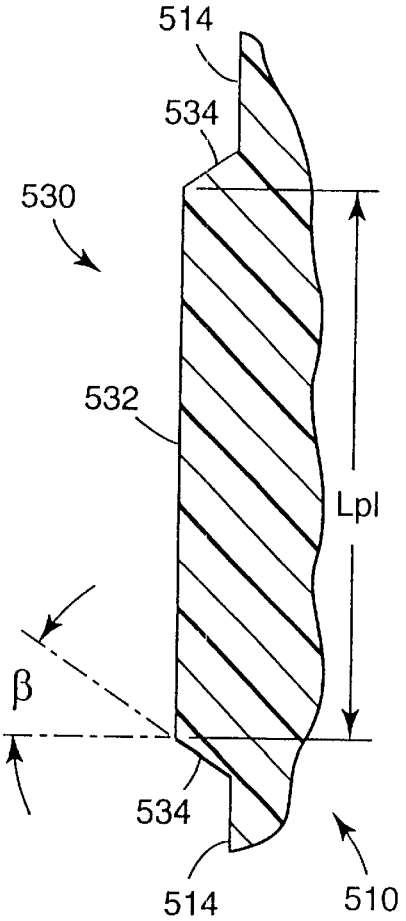
FIG. 9C is an enlarged partial cross-sectional view of the pavement marking of FIG. 8 taken along line 9C—9C.
Figure 9D:
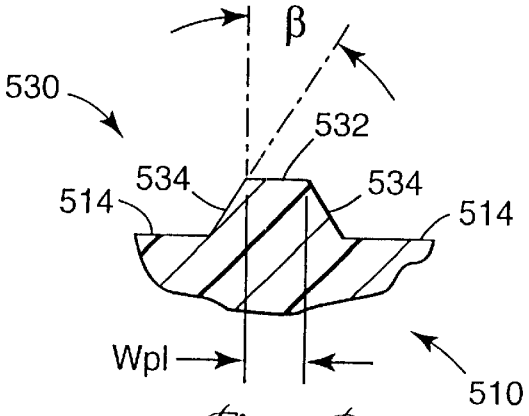
FIG. 9D is an enlarged partial cross-sectional view of the pavement marking of FIG. 8 taken along line 9D—9D.
Figure 10:
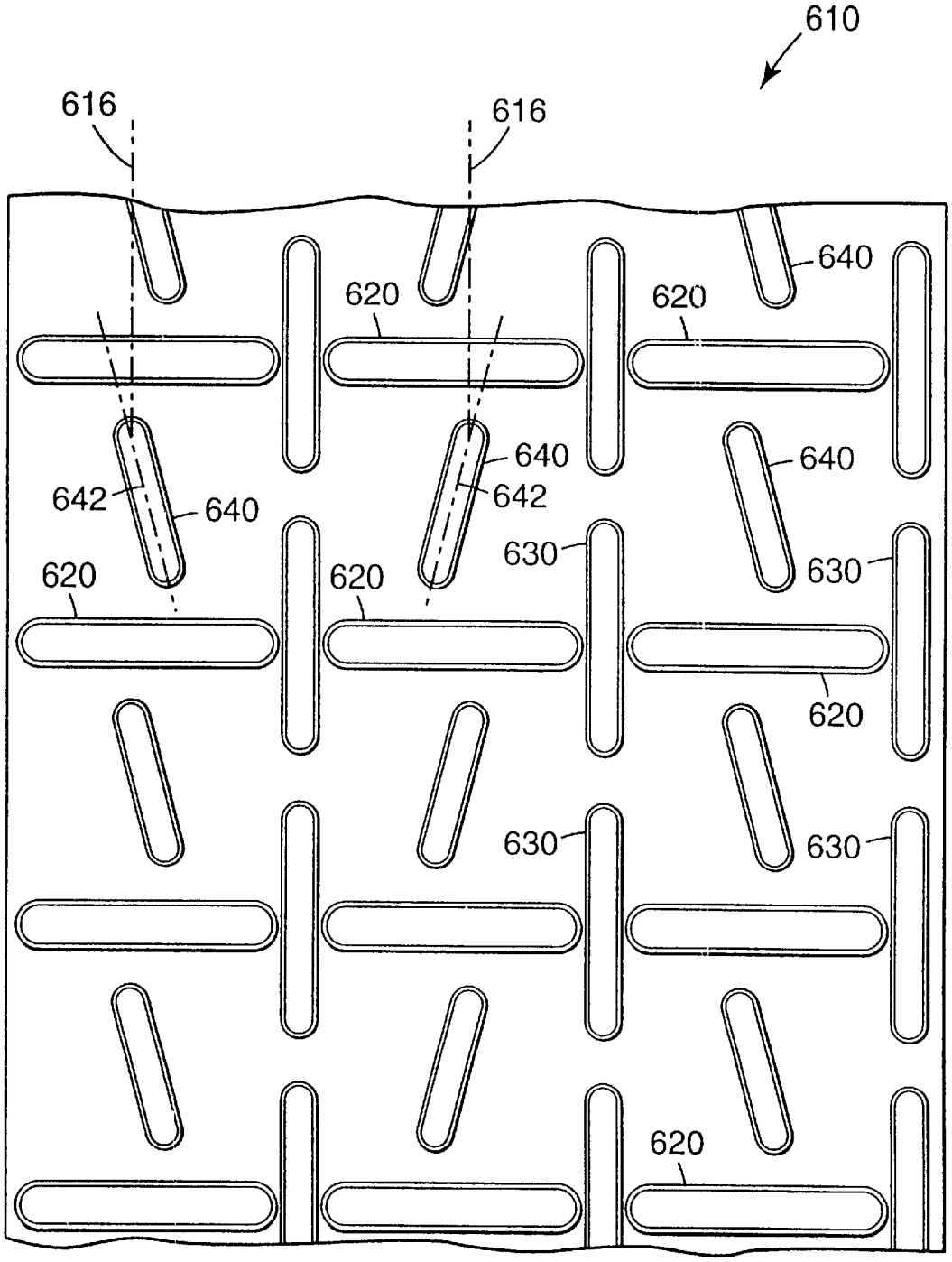
FIG. 10 is a top view of an alternate pavement marking according to the present invention.

FIGS. 8–10 illustrate alternative embodiments of pavement markings according to the present invention. Like the pavement markings described above, the markings illustrated in FIGS. 8–10 include protuberances that overlap along the longitudinal axis to improve the wear-resistant properties of the pavement marking. One advantage of the pavement markings illustrated in FIGS. 8–10 is in their manufacturability, with the illustrated patterns potentially providing increased uniformity in the solution coating processes described above with respect to FIG. 7.

Referring specifically to the pavement marking 510 illustrated in FIGS. 8 and 9A–9D, the marking includes three sets of protuberances 520, 530*a*/530*b* and 540. As illustrated, it may be preferred that the protuberances 520 be elongated with a longer (major) axis and a shorter (minor) axis generally transverse to the longer axis. It may further preferred that the protuberances 520 be aligned with their longer axes generally transverse to the longitudinal axis 516 of the pavement marking 510. In those situations in which the pavement marking 510 is oriented such that the longitudinal axis 516 is generally aligned with the direction of travel of incident light from, e.g., a vehicle headlight, the broader sides of the first set of protuberances 520 may provide a substantial portion of the conspicuity of the pavement marking 510.

The first set of protuberances 520 are preferably aligned in columns along the longitudinal axis 516 of the pavement marking 510. As illustrated, it may also be preferred that adjacent columns of the first set of protuberances 520 be offset along the longitudinal axis 516. In other words, a cross-section taken transverse to the longitudinal axis 516 would intersect at most one protuberance in the first set of protuberances 520 in any pair of adjacent columns of the first set of protuberances 520.

The protuberances in the second set of protuberances 530*a*/530*b* (referred to collectively as 530 below) are preferably elongated with a longer axis (the major axis) and a shorter axis (the minor axis) generally transverse to the longer axis. These protuberances will be referred to herein as primary elongated protuberances 530. The major axes of the primary elongated protuberances 530 are preferably substantially aligned with the longitudinal axis 516 of the pavement marking 510. The primary elongated protuberances 530 are preferably located in columns that separate pairs of adjacent columns of the first set of protuberances 520 (where the columns of both sets of protuberances are preferably aligned along the longitudinal axis 516).

Each pair of longitudinally adjacent protuberances 530 in the columns of primary elongated protuberances 530 are separated by a gap in the longitudinal direction. It is, however, preferred that at least some columns of the elongated protuberances 530 are offset along the longitudinal axis 516. As seen in FIG. 8, protuberances 530*a* in the two central columns of primary elongated protuberances are aligned across the pavement marking 510. In other words, a cross-section taken transverse to the longitudinal axis 516 of the pavement marking 510 would intersect either two or none of the primary elongated protuberances 530*a* in any pair of adjacent columns of the primary elongated protuberances 530*a*.

Other columns of the primary elongated protuberances 530*b* are, however, offset along the longitudinal axis 516 relative to the location of the columns of protuberances 530*a*. As a result, a cross-section taken transverse to the longitudinal axis 516 of the pavement marking 510 across one of the columns of protuberances 530*a* and an adjacent column of protuberances 530*b* would intersect, at most, only one of the protuberances 530*a* or 530*b*. It may be preferred that the aligned columns of protuberances 530 be provided in adjacent pairs as are the two adjacent columns of protuberances 530*a*.

The third set of protuberances 540 are located between longitudinally adjacent protuberances in the columns formed by the first set of protuberances 520. Like the primary elongated protuberances 530, each of the protuberances in the third set of protuberances 540 are preferably elongated with a longer (major) axis and a shorter (minor) axis generally transverse to the major axis and will be referred to herein as secondary elongated protuberances 540. The major axes of the secondary elongated protuberances 540 are also preferably aligned with the longitudinal axis 516. The secondary elongated protuberances 540 are also preferably long enough to bridge the longitudinal gaps between the primary elongated protuberances 530 in the adjacent columns of primary elongated protuberances 530. They are further preferably located approximately midway between adjacent columns of the primary elongated protuberances 530.

One advantage of providing the secondary elongated protuberances 540 is that, in their preferred size and location, they bridge the longitudinal gaps between longitudinally adjacent primary elongated protuberances 530 which may improve the wear-resistance of the pavement marking 510. Furthermore, the secondary elongated protuberances 540 may also serve to provide more uniform solution coating of all of the protuberances of the pavement marking 510 in manufacturing processes similar to those described above with respect to FIG. 7.

FIGS. 9A–9D illustrate various cross-sectional views of the protuberances on the pavement marking 510. Two cross-sections of one of the protuberances in the first set of protuberances 520 are illustrated in FIGS. 9A and 9B. The illustrated protuberance 520 includes an upper surface 522 that is generally planar and a sidewall 524 extending between the upper surface 522 and the valley areas 514 of the pavement marking 510. The upper surface 522 of the protuberance 520 has a length $l_t$ as seen in FIG. 9A and a width $w_t$ as seen in FIG. 9B.

Two cross-sections of one of the primary elongated protuberances 530 are illustrated in FIGS. 9C and 9D. The illustrated primary elongated protuberance 530 includes an upper surface 532 that is generally planar and a sidewall 534 extending between the upper surface 532 and the valley areas 514 of the pavement marking 510. The upper surface 532 of the primary elongated protuberance 530 has a length $l_{pl}$ along its major axis as seen in FIG. 9C and a width $w_{pl}$ along its minor axis as seen in FIG. 9D. It may be preferred that the width $w_{pl}$ of the primary elongated protuberances 530 be less than the width $w_t$ of the protuberances on the first set of protuberances 520. It may be even more preferred that the width $w_{pl}$ be about half as large as the width $w_t$ or less. These width relationships may improve solution coating uniformity.

The illustrated secondary elongated protuberances 540 preferably have a width (measured along their minor axes) that is generally equal to the width $w_{pl}$ of the primary elongated protuberances 530. As discussed above, the length of the secondary elongated protuberances 540 as measured along the longitudinal axis 516 is preferably sufficient to bridge the longitudinal gaps between the primary elongated protuberances 530 in the adjacent columns of primary elongated protuberances 530.

The sidewalls 524 of the protuberances 520 form an angle $\alpha$ with an axis that is normal to the upper surfaces 522 and valley areas 514. The sidewalls 534 of the primary elongated protuberances 530 form an angle $\beta$ with an axis that is normal the upper surfaces 532 of the primary elongated protuberances 530 and the valley areas 514 of the pavement marking 510. Although not depicted, the angle of the sidewalls of the secondary elongated protuberances 540 is preferably substantially equal to the angle $\beta$ formed by the sidewalls 534 of the primary elongated protuberances 530. The height of the upper surfaces of all of the protuberances 520, 530 and 540 may preferably be substantially equal.

Alternatively, the protuberances in the first set of protuberances 520 may be shorter than the elongated protuberances 530 and 540.

It may be preferred that the angle α formed by the sidewalls 524 of the protuberances 520 be less than the angle β formed by the sidewalls 534 of the primary elongated protuberances 530. The difference in sidewall angles may assist in uniformity of solution coating of the protuberances. In one embodiment, angle α may be about 20 degrees and angle β may be about 30 degrees.

FIG. 10 illustrates another pavement marking 610 including three sets of protuberances 620, 630, and 640. Like the pavement marking 510 discussed above, pavement marking 610 also preferably offers the advantage of improved uniformity in the solution coating manufacturing processes described above.

As illustrated, it may be preferred that the first set of protuberances 620 be elongated with a longer (major) axis and a shorter (minor) axis generally transverse to the longer axis. It may further preferred that the protuberances 620 be aligned with their longer axes generally transverse to the longitudinal axis 616 of the pavement marking 610. In those situations in which the pavement marking 610 is oriented such that the longitudinal axis 616 is generally aligned with the direction of travel of incident light from, e.g., a vehicle headlight, the broader sides of the first set of protuberances 620 can provide a substantial portion of the conspicuity of the pavement marking 610.

The protuberances in the first set of protuberances 620 are preferably aligned in columns along the longitudinal axis 616 of the pavement marking 610. As illustrated, it may also be preferred that adjacent columns in the first set of protuberances 620 be aligned along the longitudinal axis 616. In other words, a cross-section of the pavement marking 610 taken transverse to the longitudinal axis 616 would intersect either two protuberances 620 or none of the protuberances 620 in any pair of adjacent columns of the first set of protuberances 620.

The second set of protuberances 630, referred to herein as the primary elongated protuberances 630, are preferably elongated with a longer (major) axis and a shorter (minor) axis generally transverse to the major axis and will be referred to herein as primary elongated protuberances 630. The major axes of the primary elongated protuberances 630 are preferably substantially aligned with the longitudinal axis 616. The primary elongated protuberances 630 are preferably located in columns that separate the columns of protuberances in the first set of protuberances 620 (where the columns of both sets of protuberances 620 and 630 are aligned along the longitudinal axis 616).

Each pair of longitudinally adjacent protuberances in the columns of primary elongated protuberances 630 are separated by a gap in the longitudinal direction. Adjacent columns of primary elongated protuberances 630 are aligned across the width of the pavement marking, i.e., transverse to the longitudinal axis 616. In other words, a cross-section of the pavement marking 610 taken transverse to the longitudinal axis 616 would intersect either two of the protuberances 630 or none of the protuberances 630 in any pair of adjacent columns of primary elongated protuberances 630.

The protuberances in the third set of protuberances 640 are located between longitudinally adjacent protuberances 620 in each column in the first set of protuberances 620. Like the primary elongated protuberances 630, each of the protuberances in the third set of protuberances 640 are preferably elongated with a longer (major) axis and a shorter (minor) axis generally transverse to the major axis and will be referred to herein as secondary elongated protuberances 640.

The major axes of the secondary elongated protuberances 640 are canted with respect to the longitudinal axis 616. In other words, although the major axes 642 of the secondary elongated protuberances 640 form an angle with respect to the longitudinal axis 616 that is greater than zero degrees and preferably less than about 90 degrees, more preferably less than about 45 degrees. In the illustrated pavement marking 610, the secondary elongated protuberances 640 are canted or rotated from the longitudinal axis 616 by about fifteen degrees in either direction.

The secondary elongated protuberances 640 also preferably bridge the longitudinal gaps between the protuberances 630 in the adjacent columns of primary elongated protuberances 630. They are further preferably located approximately midway between adjacent columns of the primary elongated protuberances 630.

One advantage of providing the secondary elongated protuberances 640 is that, in their preferred size, location and orientation, they bridge the longitudinal gaps between longitudinally adjacent primary elongated protuberances 630 which may improve the wear-resistance of the pavement marking 610. Furthermore, the secondary elongated protuberances 640 may also serve to provide more uniform solution coating of the first set of protuberances 620 in manufacturing processes similar to those described above with respect to FIG. 7.

The relative widths of the protuberances 620, 630 and 640 of pavement marking 610 are preferably similar to those discussed above with respect to the protuberances 520, 530 and 540 of pavement marking 510. In other words the protuberances 620 in the first set are preferably wider than the primary and secondary elongated protuberances 630 and 640. In addition, the sidewalls of the protuberances 620 in the first set are also preferably steeper than the sidewalls of the elongated protuberances 630 and 640, i.e., the sidewalls of the protuberances 620 in the first set form a smaller angle with respect to a normal axis than do the sidewalls of the elongated protuberances 630 and 640.

Although different patterns of protuberances are depicted in the figures and described above, it will be understood that many other patterns could be used in pavement markings according to the present invention. Variations in the size, height, spacing, and arrangement of the different protuberances and/or columns could all be provided as long as the overlap between successive elongated protuberances was maintained. Furthermore, although the depicted patterns include only two or three different protuberances, it will be understood that more than three differently shaped protuberances could also be provided in pavement markings according to the present invention and, further, that more than one shape of elongated protuberances could be provided while remaining within the scope of the present invention.

Material Considerations

Suitable base sheets for pavement markings according to the present invention may be formed using known methods and materials, such as described in U.S. Pat. Nos. 4,117,192; 4,388,359; 4,490,432; and 5,643,655. The embossed rubber base sheet may comprise elastomer precursors, not yet vulcanized or cured, which therefore permit viscoelastic deformation. Exemplary materials include acrylonitrile-butadiene polymers, millable urethane polymers and neoprenes. Illustrative examples of other rubber materials that may be employed in the base sheet include styrene-butadiene block copolymers, natural rubber, chlorobutadiene, polyacrylates, carboxyl-modified acrylonitrile-butadienes (see U.S. Pat. No 4,282,281). Extender resins—preferably halogenated polymers such as chlorinated paraffins, but also hydrocarbon resins or polystyrenes—preferably are included with the non-crosslinked elastomer precursor ingredients and are miscible with, or form a single phase with, the elastomer precursor ingredients. Thermoplastic reinforcing polymers preferably are dispersed in the elastomer precursor as a separate phase. Suitable thermoplastic reinforcing polymers include polyolefins, especially polyethylene, vinyl copolymers, polyethers, polyacrylates, polyurethanes, styreneacrylonitrile copolymers and cellulose derivatives.

In addition to the rubber component, the base sheet also preferably includes fillers. As the term is used herein, "fillers" means an inert inorganic mineral material, typically in powder form, that is contained in the interior of the base sheet. The fillers may be included in the base sheet for a number of reasons, for example, to alter stiffness, to decrease cost, and to improve surface hardness and abrasion resistance. Examples of fillers that may be added to the base sheet include talc, mica, white pigments such as TiO2 (white pigments are designated in the Colour Index as pigment whites under the notation "P.W."), silicates, glass beads, calcium carbonate, carbon black, asbestos, barytes, blanc fixe, slate flour, soft clays, et cetera. Most common fillers are TiO2, SiO2, and talc. The fillers typically are added to the base sheet at about 50 to 80 percent by weight, more typically at about 60 to 75 percent by weight, based on the weight of the base sheet.

As indicated above, the invention is also suitable for pavement markings that display a daytime color other than white as discussed in U.S. Pat. Nos. 5,593,246 and commonly-assigned U.S. Patent Application titled RETRROREFLECTIVE BLACK PAVEMENT MARKING ARTICLES, filed on Jul. 16, 1997 (U.S. Ser. No. 08/895,297).

The pavement markings according to the present invention may include coatings or other materials in addition to the base sheet to attach optical elements and/or skid-resistant particles to the pavement marking as desired. Any coating materials are preferably highly cohesive and resistant to environmental weathering.

Optical elements suitable for use in the invention include glass microspheres (also known as beads or retroreflective beads) formed of glass materials having indices of refraction of from about 1.5 to about 1.9. As is well known in the art, glass microspheres of material having an index of refraction of about 1.5 are less costly and more durable than glass microspheres of material having an index of refraction of from about 1.75 to about 1.9; however, the less expensive, durable glass microspheres can be less effective retroreflectors.

The microspheres preferably have a diameter compatible with the size, shape, spacing and geometry of the protuberances present on the base sheet. Typically, microspheres of from 50–350 micrometers in diameter may be suitably employed. Other factors affecting element size are the number of rows of beads desired to be available to vehicle headlights.

Optical elements useful in the present invention are disclosed in U.S. Pat. Nos. 4,564,556 and 4,758,469 and are generally described therein as solid, transparent, non-vitreous, ceramic spheroids comprising at least one crystalline phase containing of at least one metal oxide. The ceramic spheroids also may have an amorphous phase such as silica. The term non-vitreous means that the spheroids have not been derived from a melt or mixture of raw materials capable of being brought to a liquid state at high temperatures, like glass. The spheroids are resistant to scratching and chipping, are relatively hard (above 700 Knoop hardness), and are made to have a relatively high index of refraction (ranging between 1.4 and 2.6). These optical elements may comprise zirconia-alumina-silica and zirconia-silica.

Further, it will be understood that other optical elements such as plastic or ceramic microspheres may be used if desired and that the present invention is not to be limited to the use of glass optical elements.

Skid-resistant particles used in connection with pavement markings according to the present invention can be, for example, ceramics such as quartz or aluminum oxide or similar abrasive media. Skid-resistant particles may also include fired ceramic spheroids having a high alumina content such as taught in U.S. Pat. Nos. 4,937,127; 5,053,253; 5,094,902; and 5,124,178. The particles do not shatter upon impact like crystalline abrasive media such as $Al_2O_3$ and quartz. Skid-resistant particles typically have sizes of about 300 to 800 micrometers.

The patents, patent documents, and publications cited herein are incorporated by reference in their entirety, as if each were individually incorporated by reference. Various modifications and alterations of this invention will become apparent to those skilled in the art without departing from the scope of this invention. For example, although specific combinations of protuberances are included in the illustrative pavement markings described above, it should be understood that the pavement markings of the present invention may include different combinations of the illustrated protuberances. Accordingly, it is to be understood that this invention is not to be limited to the illustrative embodiments set forth herein, but is to be controlled by the limitations set forth in the following claims and any equivalents thereof.

What is claimed is:

1. A pavement marking comprising:

a base sheet having first and second major surfaces, the base sheet having a longitudinal axis and a width generally perpendicular to the longitudinal axis;

a plurality of first protuberances projecting from the first major surface of the base sheet; and a pattern of a plurality of elongated protuberances projecting from the first major surface of the base sheet, wherein the plurality of elongated protuberances and the plurality of first protuberances are differently shaped, wherein the elongated protuberances are arranged along the longitudinal axis, and further wherein the elongated protuberances overlap along the longitudinal axis of the pavement marking such that trailing ends of the elongated protuberances overlap leading ends of other elongated protuberances along the longitudinal axis;

such that any cross-section taken transverse to the longitudinal axis of the pavement marking intersects at least one of the elongated protuberances.

2. A pavement marking according to claim 1, wherein each of the elongated protuberances has a major axis and a minor axis, and further wherein the major axes of the plurality of elongated protuberances are aligned parallel to the longitudinal axis of the pavement marking.

3. A pavement marking according to claim 1, wherein the elongated protuberances are arranged in longitudinal columns generally aligned parallel to the longitudinal axis of the pavement marking.

4. A pavement marking according to claim 3, wherein the spacing between the elongated protuberances in each of the longitudinal columns is about equal to or less than the length of each of the elongated protuberances along the longitudinal axis of the pavement marking.

5. A pavement marking according to claim 1, wherein any cross-section taken transverse to the longitudinal marking intersects a plurality of the elongated protuberances.

6. A pavement marking according to claim 1, wherein at least some of the elongated protuberances are substantially identical in shape and are located in a substantially regular repeating pattern and further wherein at least some of the first protuberances are substantially identical in shape and are located in a substantially regular repeating pattern.

7. A pavement marking according to claim 1, further comprising a plurality of retroreflective elements attached to at least a portion of each of the plurality of first protuberances.

8. A pavement marking according to claim 7, further comprising a plurality of retroreflective elements attached to at least a portion of each of the elongated protuberances.

9. A pavement marking according to claim 1, wherein each of the elongated protuberances have a length that is greater than the width of the elongated protuberance.

10. A pavement marking according to claim 1, wherein the length of the elongated protuberances is at least about two times the width of the elongated protuberances.

11. A pavement marking according to claim 1, wherein the length of the elongated protuberances is at least about six times the width of the elongated protuberances.

12. A pavement marking according to claim 1, wherein the longitudinal spacing between the first protuberances in a longitudinal column is at least about six times the length of each of the first protuberances along the longitudinal axis of the pavement marking.

13. A pavement marking according to claim 1, wherein the elongated protuberances have a height above the first major surface of the base sheet that is greater than the height of the first protuberances above the first major surface of the base sheet.

14. A pavement marking comprising:

a base sheet having first and second major surfaces, the base sheet having a longitudinal axis and a width generally perpendicular to the longitudinal axis;

a plurality of first protuberances projecting from the first major surface of the base sheet, wherein at least some of the first protuberances are substantially identical in shape and are located in a substantially regular repeating pattern; and a plurality of elongated protuberances projecting from the first major surface of the base sheet, each of the elongated protuberances having a major axis and a minor axis with the major axes of at least some of the elongated protuberances being parallel to the longitudinal axis of the pavement marking, wherein at least some of the elongated protuberances are substantially identical in shape and are located in a substantially regular repeating pattern arranged along the longitudinal axis, wherein the shape of the first protuberances is different than the shape of the elongated protuberances, and further wherein the elongated protuberances overlap along the longitudinal axis of the pavement marking such that trailing ends of the elongated protuberances overlap leading ends of other elongated protuberances along the longitudinal axis;

such that any cross-section taken transverse to the longitudinal axis of the pavement marking intersects at least one of the elongated protuberances.

15. A pavement marking according to claim 14, wherein any cross-section taken transverse to the longitudinal axis of the pavement marking intersects a plurality of the elongated protuberances.

* * * * *

UNITED STATES PATENT AND TRADEMARK OFFICE

CERTIFICATE OF CORRECTION

PATENT NO. : 6,431,788 B1
DATED : August 13, 2002
INVENTOR(S) : Hedblom, Thomas P.

It is certified that error appears in the above-identified patent and that said Letters Patent is hereby corrected as shown below:

Title page,
Item [56], FOREIGN PATENT DOCUMENTS, delete "DE 27 16 286 A 10/1977" and insert in place thereof -- DE 27 16 826 A 10/1977 --.
U.S. PATENT DOCUMENTS, delete "5,087,148 A 2/1992 Wyckoff" and insert in place thereof -- 5,087,148 A 2/1991 Wyckoff --.

Column 3,
Line 31, delete "," following "least".

Column 15,
Line 24, delete "TiO2" and insert in place thereof -- $TiO_2$ --.
Line 29, delete "TiO2, SiO2" and insert in place thereof -- $TiO_2$, $SiO_2$ --.

Column 17,
Line 7, following "longitudinal" insert -- axis of the pavement --.

Signed and Sealed this

Fifteenth Day of July, 2003

JAMES E. ROGAN
*Director of the United States Patent and Trademark Office*